US007089682B2

(12) United States Patent
Sundqvist et al.

(10) Patent No.: US 7,089,682 B2
(45) Date of Patent: Aug. 15, 2006

(54) IMPINGEMENT SYSTEM IN THE DRYING SECTION OF A PAPER MACHINE OR THE LIKE

(75) Inventors: Hans Sundqvist, Turku (FI); Jarkko Nurmi, Turku (FI); Henrik Pettersson, Mynämäki (FI)

(73) Assignee: Metso Paper, Inc., Helsinki (FI)

( * ) Notice: Subject to any disclaimer, the term of this patent is extended or adjusted under 35 U.S.C. 154(b) by 111 days.

(21) Appl. No.: 10/478,282

(22) PCT Filed: Jun. 26, 2002

(86) PCT No.: PCT/FI02/00564

§ 371 (c)(1),
(2), (4) Date: Dec. 18, 2003

(87) PCT Pub. No.: WO03/000988

PCT Pub. Date: Jan. 3, 2003

(65) Prior Publication Data

US 2004/0128858 A1 Jul. 8, 2004

(30) Foreign Application Priority Data

Jun. 26, 2001 (FI) ..... 20011364

(51) Int. Cl.
*F26B 11/02* (2006.01)

(52) U.S. Cl. ..... 34/117; 34/443

(58) Field of Classification Search ..... 34/117, 34/443

See application file for complete search history.

(56) References Cited

U.S. PATENT DOCUMENTS

| | | | | |
|---|---|---|---|---|
| 4,536,970 | A | 8/1985 | Eskrlinen | |
| 4,944,098 | A | 7/1990 | Hella | |
| 5,063,689 | A | 11/1991 | Sollinger | |
| 5,416,979 | A * | 5/1995 | Joiner | 34/114 |
| 6,003,241 | A | 12/1999 | Komulainen | |
| 6,003,245 | A | 12/1999 | Lipponen | |
| 6,128,833 | A | 10/2000 | Juppi | |
| 6,138,380 | A | 10/2000 | Veijola | |
| 6,148,538 | A | 11/2000 | Steiner | |
| 6,523,278 | B1 | 2/2003 | Coulson | |

FOREIGN PATENT DOCUMENTS

| | | |
|---|---|---|
| CA | 2188340 | 4/1997 |
| EP | 0769464 B1 | 4/1997 |
| FI | 79369 | 12/1987 |

(Continued)

*Primary Examiner*—S. Gravini
(74) *Attorney, Agent, or Firm*—Cohen, Pontani, Lieberman & Pavane

(57) ABSTRACT

The invention relates to an air impingement system arranged outside the jacket of an air impingement roll in the drying section of a paper machine or the like for heating and drying a web travelling around the said air impingement roll. The air impingement system comprises a mainly closed hood, which has control means for directing air onto the paper web. From the hood, air is directed by blowing with at least one fan to the blower nozzles and back again into the said hood as a circulation air process, and the system incorporates at least one heating device for heating the air. The air impingement system's hood and its said equipment are used in conjunction with an air impingement roll, which is of the size of approximately 1.5–2 m in diameter. The hood of the air impingement roll is at maximum 5 m high, preferably only 1.5–2.5 m high.

16 Claims, 4 Drawing Sheets

FOREIGN PATENT DOCUMENTS

| | | |
|---|---|---|
| FI | 912416 | 11/1991 |
| FI | 104000 | 10/1999 |
| FI | 104001 | 10/1999 |
| FI | 106135 | 11/2000 |
| WO | WO 83/03269 | 9/1983 |
| WO | WO 96/32534 | 10/1996 |
| WO | WO 98/48106 | 10/1998 |
| WO | WO 98/48108 | 10/1998 |
| WO | WO 99/51813 | 10/1999 |
| WO | WO 00/00693 | 1/2000 |

* cited by examiner

IMPINGEMENT SYSTEM IN THE DRYING SECTION OF A PAPER MACHINE OR THE LIKE

PRIORITY CLAIM

This is a national stage of PCT application No. PCT/FI02/00564, filed on Jun. 26, 2002. Priority is claimed on that application and on Application No. 20011364, filed in Finland on Jun. 26, 2001.

BACKGROUND OF THE INVENTION

The invention relates to an air impingement system for heating and drying the web travelling around the air impingement roll in the drying section of a paper machine or the like.

A solution of using an air impingement system in the drying section of a paper machine or the like has been presented in U.S. Pat. No. 6,138,380, in which an air impingement roll, the diameter of which is considerably larger than the diameter of a normal drying cylinder, is used as an air impingement roll. Due to its large size, this kind of an air impingement roll does not normally even fit underneath a paper machine in the basement, when the paper machine is being modernised. The structure is also sensitive to problems caused by shredded paper. Drying can also be made more efficient with the method disclosed in U.S. Pat. No. 6,148,538, although the efficiency of the condensation means for removing moisture is not necessarily very high in structures of this kind.

SUMMARY OF THE INVENTION

The aim of the invention is to present an air impingement system that is relatively small in size and can therefore normally be installed underneath a paper machine in the basement when modernising the paper machine. Another purpose of the invention is also to avoid major modernisation work of the drying rolls and to use an air impingement system according to the invention to increase the drying capacity. It is of course possible that the system according to the invention can be used when building new paper machines.

According to the invention, outside the jacket of the air impingement roll, an air impingement system has been arranged in the drying section of a paper machine or the like, in order to heat and dry the web travelling around the air impingement roll. The air impingement system comprises a mainly closed hood, which has control means for directing air onto the paper web, and from which hood the air is directed by blowing with at least one fan to the blowing nozzles and again back to the hood as a circulation air process, and which hood comprises at least one heating device for heating the air. If the air impingement system's hood with its equipment are used in conjunction with an air impingement roll of a size of approximately 1.5–2 m in diameter and if the hood of the air impingement roll is at maximum 5 m high, preferably only 1.5–2.5 m high, the system is small enough so that the system and parts and equipment belonging to it can be installed underneath the paper machine in the basement space, the height of which is usually 5–8 m or even less.

This makes it possible to arrange more drying power even in old machines without major alterations. Often because of factors relating to size, it is not even possible to install a large drying cylinder in connection with an existing paper machine, so the already existing cylinders have to be used more efficiently than before in drying.

If the air impingement system affects at least mainly on the trailing side of the air impingement roll and to a great extent in the area of its lower half, problems caused by shredded paper can be avoided at least to a large extent, because shredded paper can get off the web already on the income side of the air impingement roll, because there is no hood or other obstacles on the income side to prevent shredded paper from freely falling down. Because the air impingement system affects mainly in the area of the lower half of the air impingement roll, the basement space can be utilised efficiently, when a paper machine is modernised or correspondingly, if it is a new paper machine, the basement need not be dimensioned at least higher than normal.

If the hood's cover area of the air impingement roll is 150° at maximum, a fairly good drying efficiency can be reached even with a hood of this size. It is also necessary that the cover area is in any case less than 180°, so that the equipment can be pulled away from the immediate proximity of the roll without complex mechanisms.

If at least part of the equipment has been located detachably in the lower part of the air impingement system or in the lower parts of the side parts, installing and maintenance can easily be carried out from the basement floor. In this connection various auxiliary equipment can of course be used, such as transfer and forklift trucks.

If the circulation air process includes at least one condensation device, with the aid of which the humidity level of the circulation air is controlled, there is no need for large air transfer ducts for incoming and exhaust air.

If the heating device is located in the direction of flow prior to the fan, there is no need for separate air guiding ducts, because the circulation air fan mixes the air efficiently.

If one gas burner, the length of which is approximately the same as the width of the web, is used as a heating device, the need for maintenance of one burner is less frequent than for several separate burners. Normally one large burner is also cheaper to acquire than several smaller burners. Also the control procedures are simple, when there is only one burner.

If the gas burner's combustion air is brought to the burner at least partially from outside of the air impingement system, the burner receives fresh air all the time and combustion takes place in a clean and efficient way.

If the air duct from the circulation air fan to the nozzle chamber is at least mainly straight, flow losses are as small as possible and the structure is simple and cheap to manufacture.

If there are at least two, preferably from three to five, circulation air fans, fairly small fans, which do not substantially increase the size of the system, can be used.

If the cooling agent in the condensation device is water, cooling with an appropriate effect for the purpose is achieved, but, nevertheless, no part of the condensation device gets frozen and thus it cannot cause breakdowns or the like.

If, due to the air brought into the hood for the burner, part of the circulation air is directed into the basement space underneath the paper machine, there is no need to lead air ducts elsewhere and the entire system remains very simple.

If the fan that brings air to the burner is located in the hood, the air impingement structure will be very compact and still fairly small in size, fitting into most common basement spaces underneath paper machines.

BRIEF DESCRIPTION OF THE DRAWINGS

In the following, the invention is described more in detail with reference to the accompanying drawing, in which.

DETAILED DESCRIPTION OF THE PRESENTLY PREFERRED EMBODIMENTS

Figure 1:
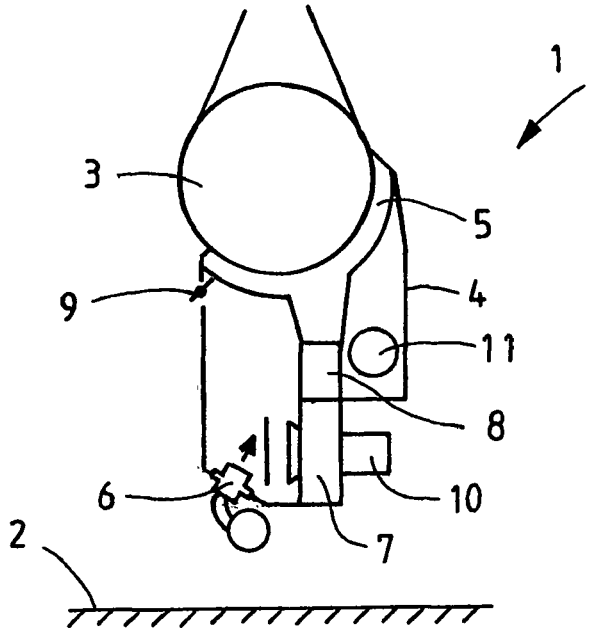
FIG. 1 is a schematic view of an air impingement system according to the invention in the drying section of a paper machine or the like, seen in the cross direction of the web.

The reference numeral 1 in FIG. 1 of the drawing refers to an air impingement system according to the invention, which system has been located underneath a paper machine or the like in a basement space, the floor of which is marked with reference numeral 2. The diameter of the drying roll 3 is in many solutions about 1.5 m or approximately that, i.e. in the size range of about 1.5–2 m, and the height of the basement space underneath the paper machine is normally 5–8 m. The air impingement system comprises a hood 4, which is mainly located at the drying roll 3 underneath it, but the hood 4 is, however, on the trailing side of the drying roll 3 so that shredded paper can fall freely down. Shredded paper may even cause a web break, but normally it causes only quality deviations, which are also detrimental. The hood's cover area of the roll should be at least no more than 180°, so that the hood could be removed from its operating position when desired and particularly without any troublesome mechanisms. This is why a maximum cover area of 150° is recommended for the hood. This size already creates a fairly good drying effect. Near the roll 3 there is a nozzle box 5, which covers a section of the circumference of the roll 3, preferably almost half of it. The hood 4 incorporates the required equipment and arrangements for directing hot air to the nozzle box 5 and thus for heating and drying the web. To generate heat energy one gas burner 6 is used, the heat front of which burner is inside the hood 4. Circulation air fans 7, of which there are several, for example three, take air from inside the hood 4, which air is heated by the burner 6, and blow the air through a preferably very straight channel 8 to the nozzle box 5, from where most of the air is returned inside the hood 4 for re-circulation. Fresh combustion air is brought to the gas burner 6, and, correspondingly, a damper 9 is used to balance the amount of air in the hood 4. Outside the hood 4 there is part of the gas burner 6 and the electric motor 10 of the circulation air fan 7, because due to the burner 6 the temperature inside the hood 4 is over 300° C., or even higher. A pipe 11 has been arranged for conveying exhaust air. Normally the space between the lower part of the air impingement system and the floor 2 is 1–3 m. In order to facilitate the maintenance, monitoring and use of the equipment, a gap of at least 1.5 m is recommended, if possible. It is recommended that air impingement systems 1 were installed only from the second or third drying group onwards, so that the risk of shredded paper and machine broke gathering at the nozzle box 5 would be small. At this stage of the web the dry matter content is already quite high and the web is stronger than at the beginning of the drying group.

Figure 2:
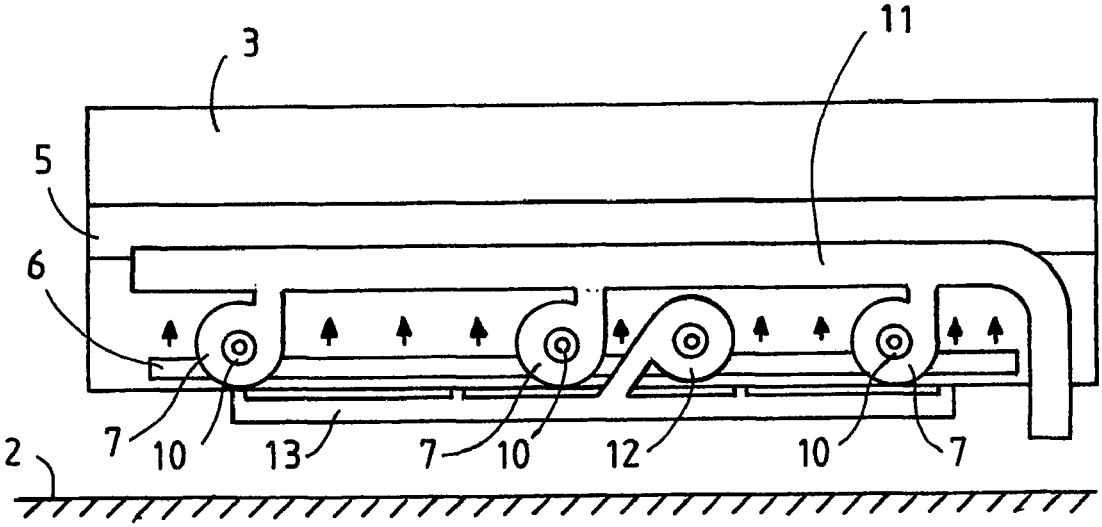
FIG. 2 is a schematic view of the air impingement system according to FIG. 1 seen in the web direction.

FIG. 2 presents the air impingement system of FIG. 1 from another direction. The walls of the hood 4 are not shown in order to make the illustration clear. With the aid of the pipe 11, exhaust air is transported out from inside the hood 4. A fan 12 transports combustion air through a pipe 13 to the burner 6.

Figure 3:
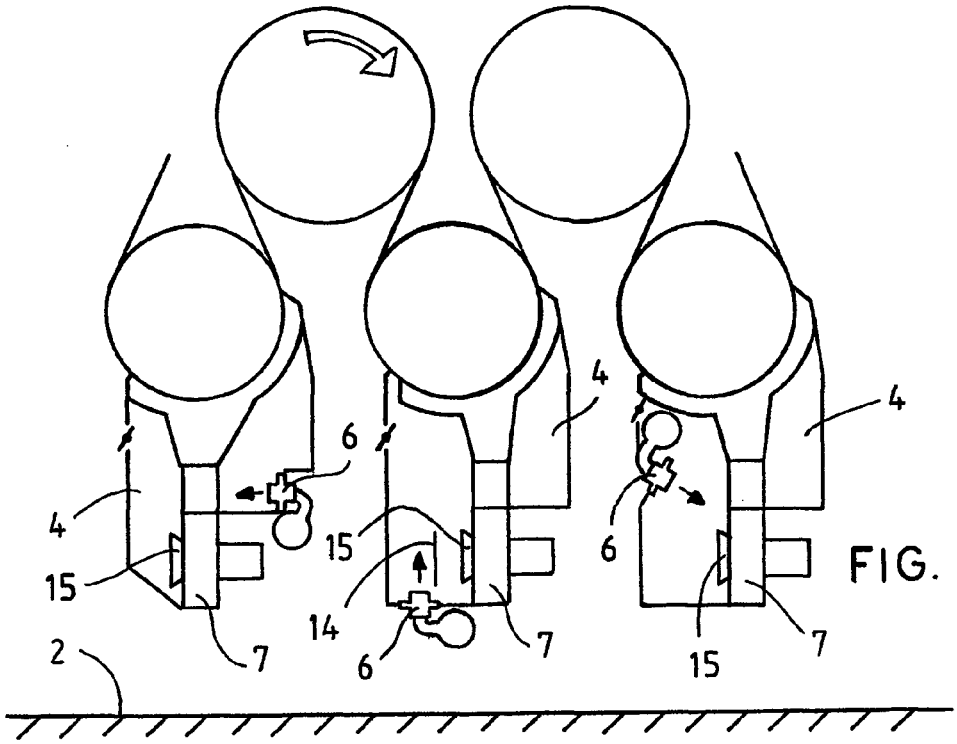
FIG. 3 is a schematic view of the various alternative locations of the burners.

FIG. 3 presents various alternative locations for the burners 6. The air impingement systems according to the invention have been located in three successive lower drying cylinders. The devices are very similar compared to the solution in FIG. 1, but the gas burner 6 in the web direction has been located in the first case quite high in the right-hand section of the hood 4, in the next case in the lower part of the hood, and in the last case rather high. It is necessary to position the gas burner so that it does not heat any of the walls or equipment of the hood 4 excessively. If necessary, a steel plate wall 14 or the like can be used so that the effect of the burner is not too directly towards the suction hole 15 of the circulation air fan 7. It is to be noted that placing the burner 6 partly below the hood 4 reduces the distance between the equipment and the floor 2.

Figure 4:
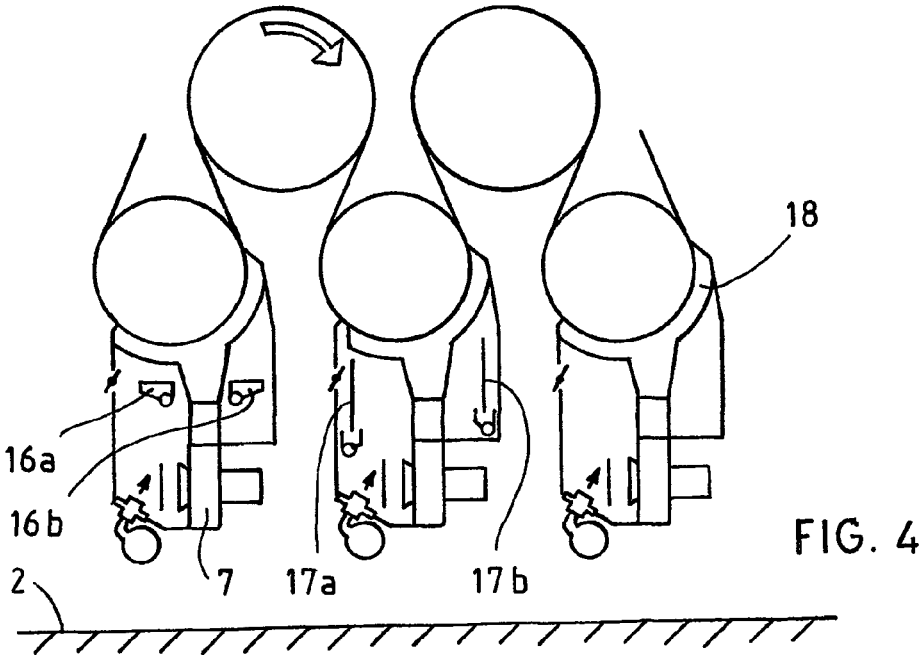
FIG. 4 is a schematic view of the various locations of the condensation devices within the hood.

FIG. 4 presents some locations of condensation devices inside the hood 4. In the first solution in the web direction, two condensation devices 16*a* and 16*b* are located near the points where the humid air that has evaporated from the web returns towards the circulation air fans. The structure of the condensation devices 16*a* and 16*b* is presented more in detail in FIG. 5. In the next solution, plate-like condensation devices 17*a*, 17*b* have been installed in the hood 4 vertically, and underneath the condensation devices collector flutes have been located. In the last solution the condensation device has been placed in the nozzle box 5 at the point shown by reference numeral 18. FIG. 6 presents the structure of this condensation device. It is essential that the temperature of the condensation device is kept so low that the moisture from the humid air condensates on the surface of the condensation device and flows along it in a tube to a collector tank (not shown). The use of a water seal (not shown) is recommended.

Figure 5:
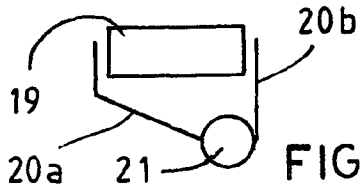
FIG. 5 is a schematic, magnified view of a condensation device.
Figure 6:
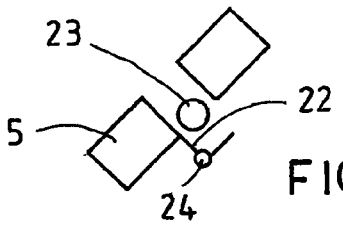
FIG. 6 is a schematic, magnified view of another condensation device.

FIG. 5 presents a condensation device 16*a*, which has in the upper part an element 19 made of piping and inside which element water circulates. Plates 20*a*, 20*b* form a condensate basin, from the bottom of which the condensate is removed via a pipe 21.

FIG. 6 presents a solution in which the wall of the nozzle box 5 is used as a part of a condensate basin 22 wall. The water runs in a pipe 23 and on its surface moisture condensates as water dripping down into the condensate basin 22, from where the condensate is removed via a pipe 24.

Figure 7:
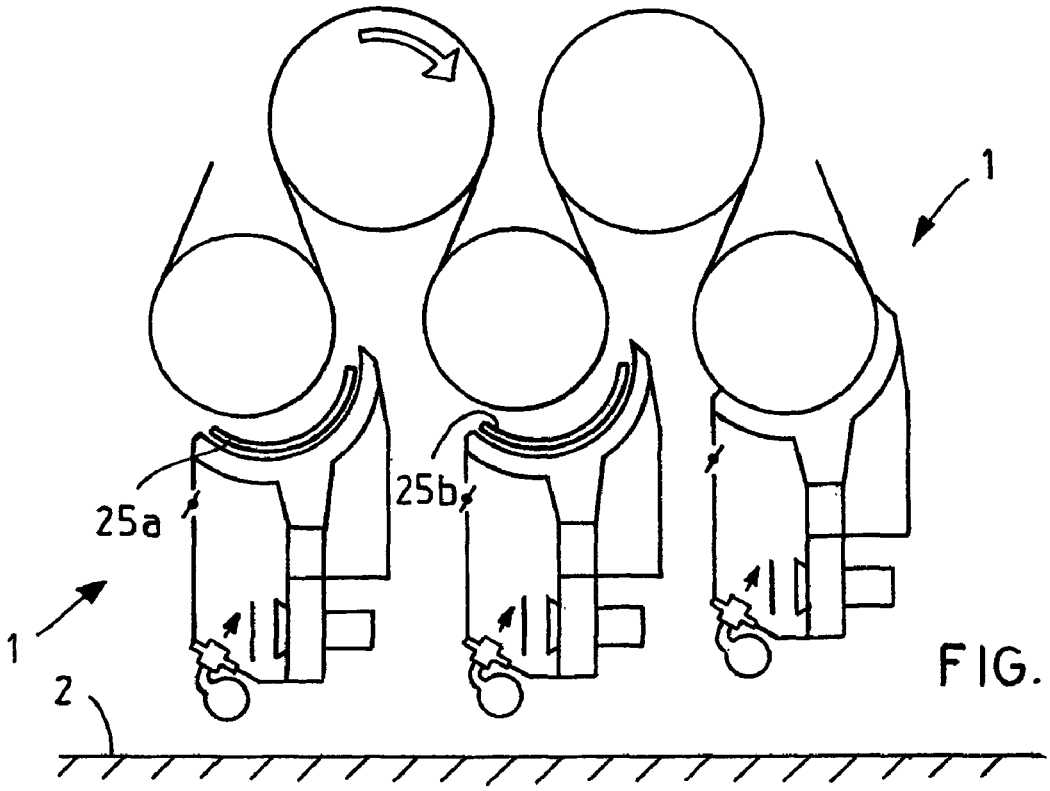
FIG. 7 is a schematic view of automatic cleaning of the air impingement system in connection of web breaks.

FIG. 7 presents an arrangement with the help of which the air impingement system is cleaned when required, and particularly when there is a web break. The first and second air impingement systems in the web direction have been moved further downwards from the drying cylinder and in a slightly diagonal direction. The moving arrangements themselves have not been shown, but one solution is to use rails and hydraulic cylinders for moving. The moving distances are only some decimeters.

Reference numerals 25*a*, 25*b* mark the movable air blower equipment, with the help of which equipment the cleaning is carried out. It is important that there is no shredded paper or dust in the air impingement system's equipment, since these normally have a detrimental effect on the product quality, malfunctions, such as blockages, may occur and there is no reason to underestimate the increased risk of fire.

Figure 8:
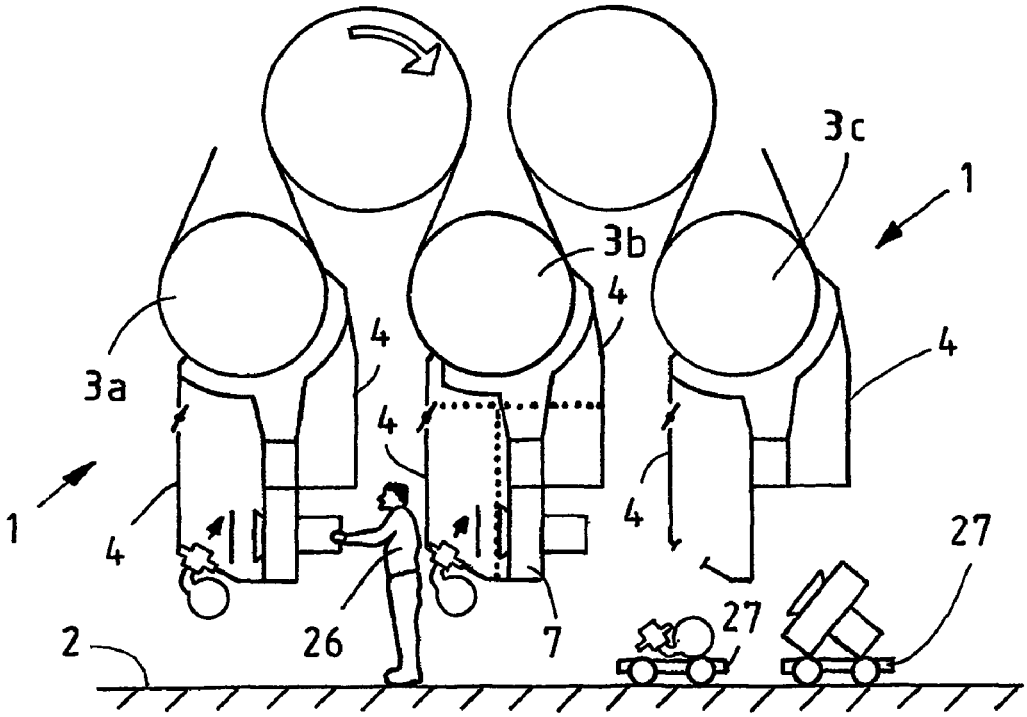
FIG. 8 is a schematic view of the arrangements for maintenance measures of the air impingement system.

FIG. 8 illustrates the installation, inspection and maintenance procedures of the air impingement system. A mechanic 26 can very easily get to work close to the different equipment of the air impingement system. The distances between drying cylinders 3*a*, 3*b*, 3*c* are usually so great that in the longitudinal direction of the paper machine, the space between the hoods 4 of the air impingement system is approximately a meter. The hood 4 of the air impingement system of the drying cylinder 3*b* has been divided by two dotted lines into compartments, which represent the space reserved for the burner 6 and correspondingly the space reserved for the circulation air fan 7. In this case maintenance or replacement work is very simple and fast to perform, especially, if carts 27 and appropriately positioned lifting lugs and other auxiliary equipment are used for moving and lifting. If the burner flame is not monitored from a screen in a control room, it is necessary to arrange at least monitoring windows (not shown) in the hood 4 in appropriate places.

Figure 9:
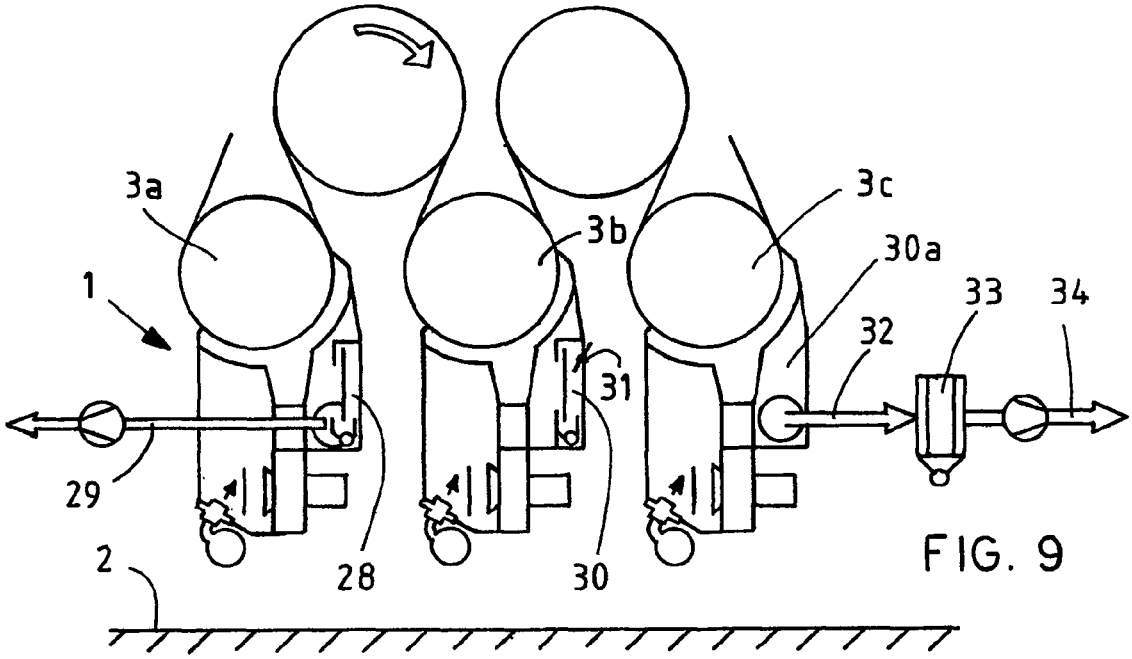
FIG. 9 is a schematic view of some alternatives for separating humidity from the exhaust air and FIG. 10 is a schematic view of the cooling system and heat recovery system that are used in conjunction with the invention.

FIG. 9 presents alternatives and arrangements for handling and moving humid and dry air. The equipment of the air impingement system 1 used in conjunction with the drying cylinder 3*a* comprises a separate chamber 28 for separating moisture, from which chamber the exhaust air is conveyed via a pipe 29 to other parts of the process. In conjunction with the drying cylinder 3*b* there is a chamber 30, which is part of the equipment of the air impingement system 1, which chamber incorporates a condensation device, its basin and outlet pipe, and from which chamber air is directed through a grille 31 to the basement space. The structure is thus very simple. In conjunction with the drying cylinder 3*c* there is a chamber 30*a*, which is part of the equipment of the air impingement system 1, in which chamber the exhaust air from the hood is conveyed by a pipe 32 to a common condensation device 33 and further on via a pipe 34 to be used as dry air. It is true that in this case the circulation process is rather easily controllable, but this arrangement requires more piping and equipment outside the hood 4 than the other alternatives.

Figure 10:
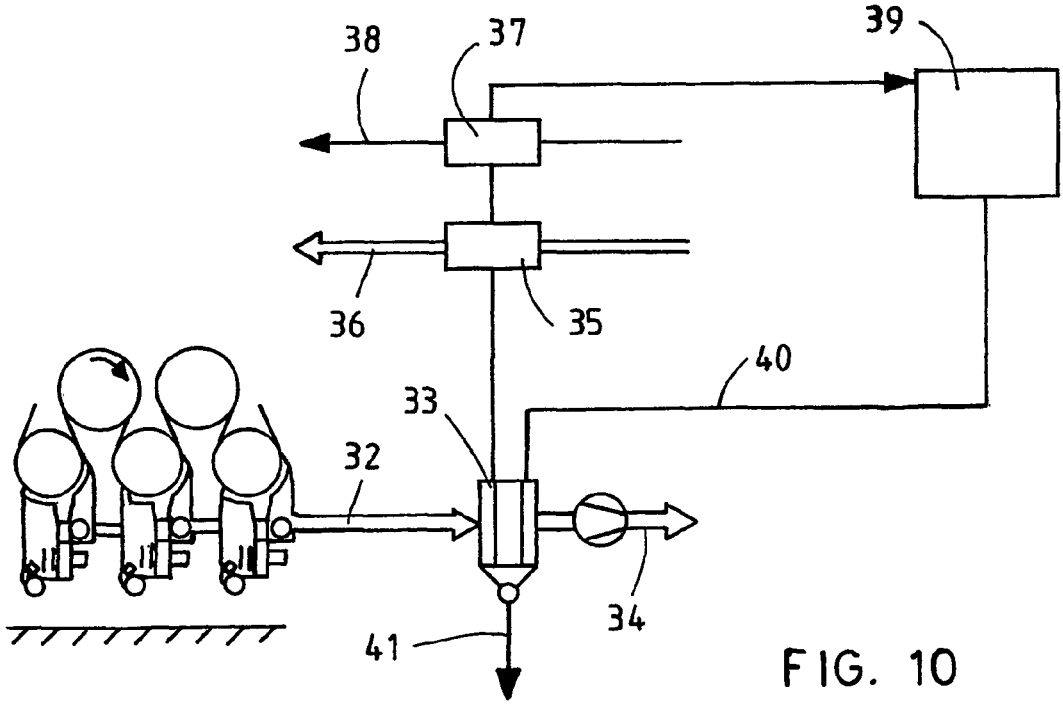

The lower part of FIG. 10 presents arrangements according to FIG. 9 with the help of which the exhaust air transported away from hoods 4, which air is quite hot, is condensed in the condensation device 33, from where the dry air is conveyed via the pipe 34 for use. With the heat exchanger 35 preheated feed air is arranged to pass into the drying section with the help of a pipe 36, and with the heat exchanger 37 hot process water is arranged to pass into the process with the help of a pipe 38. Via a cooling tower 39 the condensate moves along a pipe 40 on to a pipe 41 for use as hot process water in the process. Of course, hot process waters can also be used for other purposes, such as e.g. heating the paper machine hall or other purposes.

A system according to the invention saves a lot of space around the air impingement hoods 4 and the entire paper machine, because instead of a large supply air and exhaust air manifold and heat recovery, only a rather small water pipeline is needed to convey condensate, and possibly a short exhaust air duct out from the hood 4. If hoods and other quite large structural parts have been divided into two or more smaller parts already at the planning phase, they can, for example, in connection with paper machine rebuilds be moved under the paper machine into the basement without dismounting drying cylinders or other large parts of the paper machine, and at the installation phase they can be connected to form air impingement systems according to the invention. A recommendable solution is that when a paper machine is modernised, the drying cylinders are not replaced, but an air impingement system according to the invention is installed in conjunction with the drying cylinders. In this case the alterations are minor and can be performed rapidly and usually there are no problems concerning space either. Usually in this case costs are also saved.

The invention is not limited to the embodiment described above, but several modifications of it may be feasible within the scope of the accompanying claims.

The invention claimed is:

1. An air impingement system for heating and drying a web travelling around a roll of a drying section, comprising:

a single hood positioned so as to surround a portion of the roll upon which the web travels in the drying section, the web wrapping around a lower portion the roll, the hood surrounding a portion of the web extending from proximate a location where the web separates from the roll on a trailing side of the roll and so that a portion of an incoming side of the roll where the web contacts the roll is not wrapped by the hood;

at least one fan;

a heating device for heating the air blown by the at least one fan; and an air directing means for directing air blown by the at least one fan onto a portion of a surface of the web as the web travels around the roll within the hood;

wherein the hood is positioned so that air blown onto the web circulates within the hood.

2. The air impingement system of claim 1, wherein the hood surrounds the roll up to a maximum of 150°.

3. The air impingement system of claim 1, wherein at least some elements of the air impingement system are detachable.

4. The air impingement system of claim 3, further comprising at least one condensation device to aid in adjusting a moisture content of the circulating air.

5. The air impingement system of claim 4, wherein the heating device is located before the said at least one fan in the direction of air flow.

6. The air impingement system of claim 1, wherein the heating device comprises a gas burner having a length approximately the same as a width of the web.

7. The air impingement system of claim 6, further comprising a means for supplying combustion air to the gas burner at least partially from outside of the air impingement system.

8. The air impingement system claim 1, further comprising an air duct configured to direct air from the at least one fan to the portion of the surface of the web, said air duct being substantially straight.

9. The air impingement system of claim 1, comprising at least two fans.

10. The air impingement system of claim 4, wherein the at least one condensation device uses water as a cooling agent.

11. The air impingement system of claim 1, wherein part of the circulation air is directed out of and below the air impingement system.

12. The air impingement system of claim 6, further comprising a burner fan that brings air to the burner.

13. The air impingement system of claim 9, comprising three to five fans.

14. The air impingement system of claim 12, wherein the burner fan is located in the hood.

15. A method for heating and drying a web travelling around a roll of a drying section, comprising:

positioning a single hood so as to surround a portion of the roll upon which the web travels in the drying section, the web wrapping around a lower portion the roll, the hood surrounding a portion of the web extending from proximate a location where the web separates from the roll on a trailing side of the roll and so that a portion of an incoming side of the roll where the web contacts the roll is not wrapped by the hood; and directing heated air onto a portion of a surface of the web as the web travels around the roll within the hood.

16. The method of claim 15, wherein the hood surrounds the roll up to a maximum of 150°.

* * * * *